United States Patent [19]

Kazumi

[11] Patent Number: 4,638,137

[45] Date of Patent: Jan. 20, 1987

[54] HEATING APPLIANCE HAVING A FAIL-SAFE START SWITCH

[75] Inventor: Hirai Kazumi, Nabari, Japan

[73] Assignee: Matsushita Electric Industrial Co., Ltd., Osaka, Japan

[21] Appl. No.: 639,615

[22] PCT Filed: Sep. 21, 1981

[86] PCT No.: PCT/JP81/00241

§ 371 Date: Apr. 29, 1982

§ 102(e) Date: Apr. 29, 1982

[87] PCT Pub. No.: WO82/01056

PCT Pub. Date: Apr. 1, 1982

Related U.S. Application Data

[63] Continuation of Ser. No. 380,863, Apr. 29, 1982, abandoned.

[30] Foreign Application Priority Data

Sep. 22, 1980 [JP] Japan ..... 55-132089

[51] Int. Cl.[4] ..... H05B 6/64

[52] U.S. Cl. ..... 219/10.55 B; 219/10.55 C; 219/10.55 D

[58] Field of Search ..... 219/10.55 B, 10.55 D, 219/10.55 C

[56] References Cited

U.S. PATENT DOCUMENTS

| | | | |
|---|---|---|---|
| 3,691,329 | 9/1972 | Ball | 219/10.55 C |
| 3,823,294 | 7/1974 | Takayama et al. | 219/10.55 C |
| 4,158,431 | 7/1979 | Van Bavel . | |
| 4,190,756 | 2/1980 | Foerstner . | |

FOREIGN PATENT DOCUMENTS

| | | | |
|---|---|---|---|
| 0058207 | 4/1972 | European Pat. Off. . | |
| 2444143 | 7/1980 | France . | |
| 52-32471 | 8/1977 | Japan . | |
| 53-124340 | 10/1978 | Japan | 219/10.55 C |
| 53-136739 | 11/1978 | Japan . | |
| 2010954 | 7/1979 | United Kingdom . | |

*Primary Examiner*—Harold Broome
*Assistant Examiner*—M. M. Lateef
*Attorney, Agent, or Firm*—Wenderoth, Lind & Ponack

[57] ABSTRACT

This invention relates to a fail-safe device for a heating appliance having a control system based upon a microcomputer. More particularly, there is provided a heating appliance which prevents malfunction of the control system caused by faulty operation of the microcomputer through the operation of heating start switches which are mechanically operable independently of control signals introduced via a keyboard thus assuring a high degree of safety.

3 Claims, 6 Drawing Figures

HEATING APPLIANCE HAVING A FAIL-SAFE START SWITCH

This application is a continuation of now abandoned application Ser. No. 380,863, filed Apr. 29, 1982 now abandoned.

BACKGROUND OF THE INVENTION

1. Field of the Invention

This invention relates to a fail-safe device for a heating appliance having a microcomputer-aided control, and more particularly provides a highly safe heating appliance which prevents malfunction of a control device originating from faulty operation of a microcomputer through the use of a heating start switch operating mechanically independently of control signals introduced via a keyboard.

2. Description of the Prior Art

In recent years, high frequency heating appliances have been put on the market as one of cooking tools with an electronic control system including in combination a microcomputer and a keyboard. In other words, the use of the microcomputer in high frequency heating appliances has offered numerous advantages: for example, timekeeping faculty, a plurality of selectable output levels, a plurality of selectable programmed cooking modes, availability of one or more sensors, etc. and therefore a remarkable improvement in convenience for the users and cooking applications. It is however known that the electronic microcomputer-aided control system is susceptible to noise induced from lightning, noise originating from a power supply and the high frequency heating appliance sometimes fails to operate due to such noise. To assure further effective utilization of the microcomputer, it is necessary for the control system to show a high resistance to noise or the like.

FIG. 1 is a perspective view illustrating the appearance of a conventional cooking appliance. In FIG. 1, a door 2 is openably and closably installed at the front of a main body 1. An operational panel 3 carries a display 4 and a keyboard 5, with the latter including heating mode selection keys 6, digit keys 7, a cooking start key 8, etc.

FIG. 2 is a circuit diagram of the conventional cooking appliance, wherein a power supply source 9 is connected to a high voltage transformer 14 through fuse 10, a switch 11 operatively interlocked with opening and closing movement of the door 2, a switch 12 and a relay contact 13. A high frequency oscillator is conventionally made of a magnetron 15 for which a power supply circuit is provided by a half-wave rectifying voltage multiplier including a capacitor 16, a diode 17 and the high voltage transformer 14.

A control board 18 is supplied with power from a low voltage transformer 19, which board carries a microcomputer 20 connected to a keyboard 5 via an interface 21. The interface 21 converts signals from the keyboad 5 into signals which are compatible with the microcomputer 20. The microcomputer 20 permits the resultant signals to be displayed on a display panel 23 and to be processed pursuant to a stored program and provides its output signal for a relay coil 24 via a converter 22 for placing its relay contact 13 into closed or open position.

For example, when a desired cooking period is preset via the digit key or keys 7 on the keyboard 5 and the cooking start key 8 is actuated, the output signal of the microcomputer 20 energizes the relay coil 24 to force the relay contact 13 into closed position for a given period of time so that the magnetron 15 is supplied with an enabling voltage to commence high frequency heating. In the event that the door 2 is opened during the course of heating, both the switches 11 and 12 are opened so as to interrupt the oscillation.

Should a high voltage originating from lightning, for example, be impressed on the high frequency heating appliance with the above illustrated conventional circuit arrangement, such electronic components as the microcomputer 20, the interface 21 and the converter 22 may be destroyed with a possibility of developing from the converter 22 a signal which may energize the relay coil 24. In this case, the magnetron 15 starts oscillating as long as the door is in closed position.

Because of no limited heating period of time being preset, the appliance continues oscillating and remains in abnormal heating condition without a load and thus is in danger of being operated with a lack of security. In particular, a high voltage resulting from induced lightning would increase the possibility of destroying a low breakdown voltage circuit and the appliance can be regarded as being constantly exposed to a dangerous situation because lightning can occur any time in the daytime or at night.

SUMMARY OF THE INVENTION

Accordingly, it is an object of the present invention to provide a high-safety high frequency heating appliance which avoids abnormal oscillation of high frequency radiations during faulty operation of a circuit by the provision of a safety operator circuit set up by a combination of a keyboard for introduction of control signals and a mechanically operable latch assembly and the provision of a simplified peripheral circuit to a microcomputer. With such an arrangement, there is provided a high frequency heating appliance which is very convenient to use with satisfactory and agreeable cooking performance through the use of automated cooking modes, selection of high frequency output levels, programmed cooking modes, etc., thanks to further advanced application of the microcomputer.

It is another object of the present invention to provide a circuit arrangement for a heating start switch which assures a minimum of cutoff current and with an increase in durability and a decrease in cost.

Specific embodiments of the present invention will now be described by reference to the accompanying drawings.

DESCRIPTION OF THE PREFERRED EMBODIMENT

Figure 1:
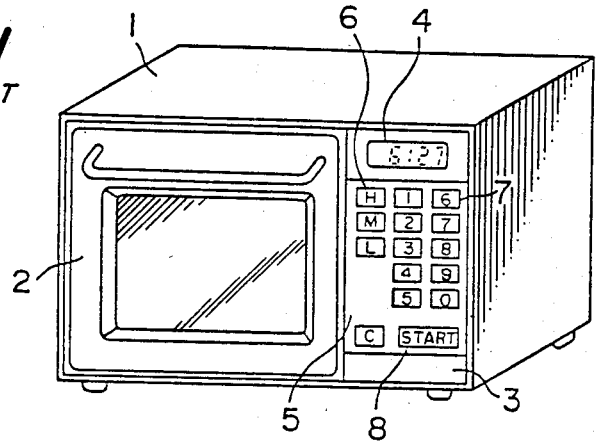
FIG. 1 PRIOR ART
FIG. 1 is a perspective view showing the appearance of a conventional heating appliance.
Figure 2:
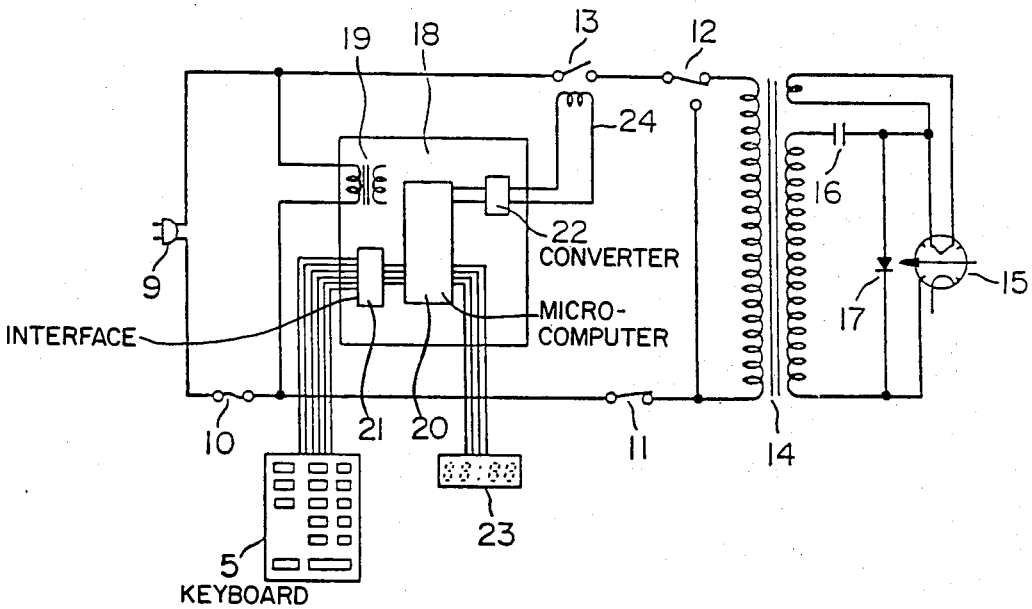
FIG. 2 PRIOR ART
FIG. 2 is a circuit diagram of the above illustrated appliance.
Figure 3:
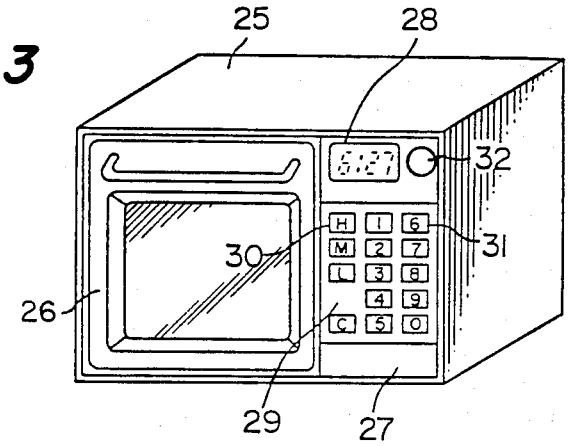
FIG. 3 is a perspective view showing the appearance of a heating appliance according to an embodiment of the present invention.

Referring now to FIG. 3, there is illustrated a door 26 openable and closable at the front of a main body 25. An operational panel 27 carries a display 28 and a keyboard 29, with the latter including heating condition selection keys 30, digit keys 31 and so forth. A cooking start button 32 is provided independently of the keyboard 29.

Figure 4:
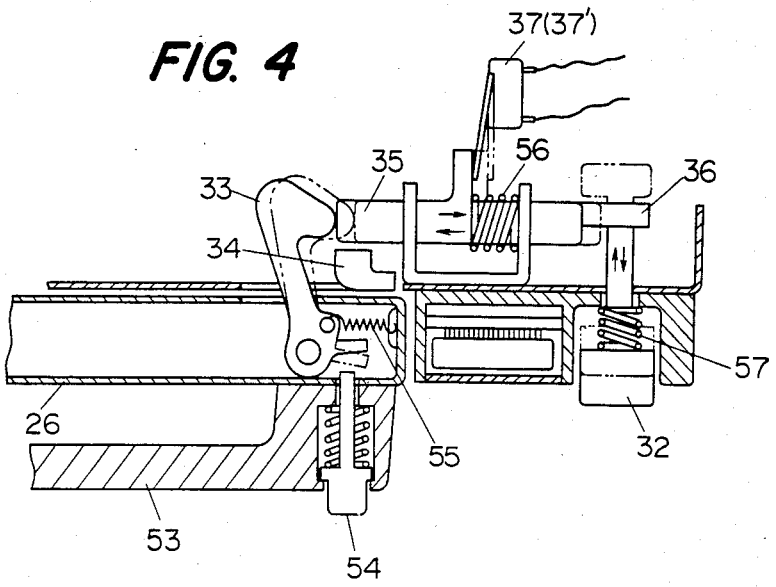
FIG. 4 is a partially cross-sectional view showing a structure of a heating start switch in the above illustrated embodiment.

FIG. 4 is a partial cross-sectional view showing an example of a heating start switch structure for use in the heating appliance according to the present invention.

In FIG. 4, a door key 33 is disposed inside the door 26, and is held in a pulling direction by a door key spring 55. When the door 26 is closed, the door key 33 is engaged with a hood 34 provided at the main body side. The state of the door key 33 in this state is shown by a solid line in FIG. 4. A slide plate 35, which is slidable to the right and left, is provided inside the hood 34 and is held in a pressing direction by a slide spring 56. This slide plate 35 is defined in a position as it is engaged with a stop plate 36 which is integral with the cooking start button 32. The button 32 has a compression spring 57, which returns the cooking start button 32 to the position indicated by the solid line in FIG. 4. This position corresponds to its usual state. When the cooking start button 32 is pressed after closing the door 26, the stop plate 36 overcomes the force of the start button spring 57 and moves up to the position indicated by the double-dot chain line in FIG. 4. As a result, the slide plate 35 is dislocated from the stop plate 36, and overcomes the returning force of the slide spring 56, and the door key spring 55 is actuated and the slide plate 35 is pushed by the door key 33 and moves to the right as indicated by the double-dot chain line in FIG. 4, so that the heating start switches 37 and 37′ are operated (e.g.—closed). Next, when the button 54 of the handle 53 is pressed in order to open the door 26, the plunger of button 54 moves the door key 33 to the position indicated by the solid line in FIG. 4, and the slide plate 35 returns to the original position due to the repulsive force of the slide spring 56 so as to open the cooking start switches 37 and 37′. At the same time, the stop plate 36 and cooking start button 32 are returned to their original positions by the force of the start button spring 57.

Figure 5:
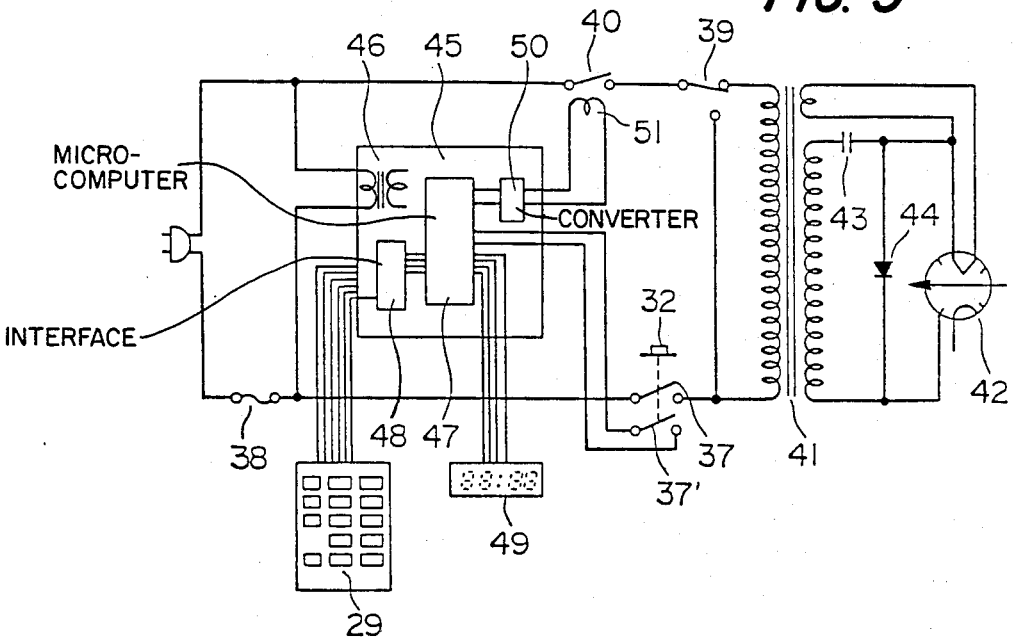
FIG. 5 is a circuit diagram of the above illustrated embodiment.

In FIG. 5, a power source is connected to a high voltage transformer 41 through a fuse 38, the heating start switch 37, a switch 39 operatively interlocked with opening and closing movement of the door 26 and a relay contact 40. A power supply circuit for a magnetron 42 or a high frequency oscillator is set up by a half-wave rectifying voltage multiplier including a capacitor 43, a diode 44 and the high voltage transformer 41.

A control circuit board 45 is supplied with power from a low voltage transformer 46, which board carries a microcomputer 47 connected to the keyboard 29 by way of an interface 48. The interface 48 converts signals from the keyboard 29 into signals which are compatible with the microcomputer 47.

When the cooking start button 32 is pressed to start the cooking, the other contact 37′ of the heating start switch is closed, and a signal from this heating start switch 37′ is fed into the microcomputer 47.

The microcomputer 47 permits the resultant signals to be displayed on a display panel 49 and to be processed pursuant to a stored program and provides its output signal for a relay coil 51 via a converter 50 for opening and closing the relay contact 40.

For example, when a desired cooking period is introduced via the digit key or keys 31 on the keyboard 27 and the cooking start button 32 is actuated to bring the heating start switches 37 and 37′ into closed position, the output signal of the microcomputer 47 energizes the relay coil 51 to force the relay contact 40 into closed position for a given period of time so that the magnetron 42 is supplied with enabling voltage to start high frequency heating. In the event that the door 26 is opened during the course of heating, the heating start switches 37 and 37′ and the switch 39 are opened to interrupt oscillation. In the case where the heating start switch 37 has been melted and closed, the switch 39 establishes a short circuit so that the fuse 38 may operate (i.e.—open) and serve as a fail-safe circuit for discontinuing oscillation of the magnetron 42 and preventing risky leakage of microwave radiation.

Figure 6:
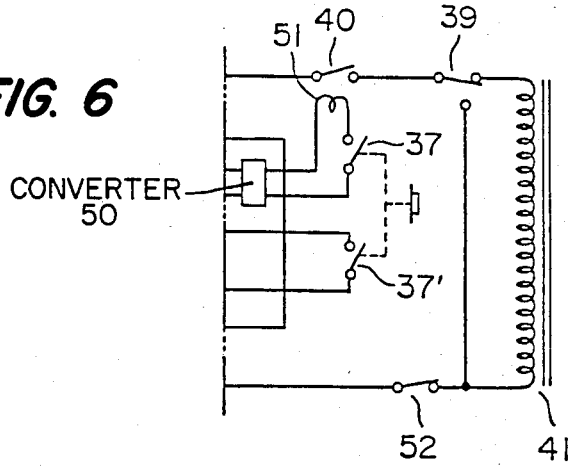
FIG. 6 shows a circuit arrangement of a heating appliance according to another embodiment of the present invention.

FIG. 6 shows a circuit arrangement according to another embodiment of the present invention with its principal component being partially illustrated.

In FIG. 6, a door switch 52 operatively interlocked with only opening and closing movement of the door 26 is connected to the high voltage transformer 41 within a main circuit and the heating start switch 37 is connected in series with the relay coil 51.

The circuit arrangement of FIG. 6 demands the heating start switch 37 to shut off only minute current flowing through the relay coil 51, resulting in a decrease in capacity requirement by the switch, an increase in durability and cost savings. It is also obvious that the heating start switch 37 is mechanically opened and closed independently of the electronic circuit arrangement and serves similarly to deenergize the relay coil 51 and avoid objectionable abnormal oscillation in the event that the electronic circuit arrangement is out of order.

As stated previously, even though a high voltage is developed due to induced lightning, for example, to an extent that will destroy such electronic components as the microcomputer 47, the interface 48 and the converter 50 and if the converter 50 is so destroyed as to produce a voltage signal which is high enough to activate the relay coil 51 and actually place the relay contact 40 into closed position, the heating appliance embodying the present invention shuts off the main power supply circuit and never allows the magnetron 42 to oscillate unintentionally because of the normally-open heating start switch 37 as long as the cooking start button 32 is not depressed.

The electronic circuit arrangement is constantly in danger of being destroyed since a high voltage resulting from induced lightning, for example, may easily break down the electronic circuit arrangement generally having a low breakdown voltage and lightning may occur any time in the daytime or at night. In such case, the appliance prevents any abnormal loadless heating or fire in advance and assures a high degree of safety.

The provision of the mechanical cooking start button 32 spaced away from the keyboard 29 not only avoids malfunction in the case of induced lightning but also prevents oscillation of the high frequency radiation when the cooking start button is inadvertently depressed while the surface of the keyboard 29 is being wiped with a cloth or the like. This assures further safety.

Automated heating modes aided with a sensor or sensors for monitoring the process of heating, selection of high frequency output levels and programmed cooking modes relying upon combinations of the first two measures are of course available wherenever desired thanks to the utilization of the microcomputer. Furthermore, the appliance exhibits pleasant and satisfactory cooking performance. The display may serve easily as a timekeeper.

I claim:

1. A heating appliance having a microcomputer which is governed by input signals introduced via a keyboard and having an oscillator which is controlled by output signals from said microcomputer and having a main power supply circuit which is enabled only in response to a manual operation of a heating start switch which is mechanically operable independently of said keyboard.

2. A heating appliance as set forth in claim 1, wherein said oscillator is controlled by said output signals from said microcomputer via a relay and a heating start button which is mechanically operable independently of said keyboard is connected to a control circuit used for operating said relay.

3. A heating appliance as set forth in claim 1, wherein said heating start switch is actuated in response to a cooking start button which is spaced away from said keyboard.

* * * * *